US007490494B2

(12) United States Patent
Kim et al.

(10) Patent No.: US 7,490,494 B2
(45) Date of Patent: Feb. 17, 2009

(54) STEAM GENERATION APPARATUS FOR WASHING MACHINE

(75) Inventors: Jin-Woong Kim, Seoul (KR); Kyung-Chul Woo, Seoul (KR); Si-Moon Jeon, Seoul (KR)

(73) Assignee: LG Electronics Inc., Seoul (KR)

( * ) Notice: Subject to any disclaimer, the term of this patent is extended or adjusted under 35 U.S.C. 154(b) by 158 days.

(21) Appl. No.: 11/178,426

(22) Filed: Jul. 12, 2005

(65) Prior Publication Data

US 2006/0010937 A1 Jan. 19, 2006

(30) Foreign Application Priority Data

Jul. 13, 2004 (KR) ..... 10-2004-0054518
Feb. 28, 2005 (KR) ..... 10-2005-0016971

(51) Int. Cl.
*D06F 39/04* (2006.01)

(52) U.S. Cl. ..... 68/15

(58) Field of Classification Search ..... 134/108; 68/15

See application file for complete search history.

(56) References Cited

U.S. PATENT DOCUMENTS

| | | | | | |
|---|---|---|---|---|---|
| 2,880,300 | A | * | 3/1959 | Reimers et al. | 392/401 |
| 3,025,381 | A | * | 3/1962 | Pickering | 392/401 |
| 3,173,432 | A | * | 3/1965 | Dronberger | 392/441 |
| 3,410,986 | A | * | 11/1968 | Groom | 392/399 |
| 3,846,615 | A | * | 11/1974 | Athey et al. | 392/441 |
| 3,982,552 | A | * | 9/1976 | Fraula | 134/57 D |
| 4,334,143 | A | * | 6/1982 | Cushing | 392/441 |
| 4,572,943 | A | | 2/1986 | Hoegfeldt et al. | |
| 5,459,812 | A | * | 10/1995 | Taylor | 392/498 |
| 6,067,403 | A | * | 5/2000 | Morgandi | 392/401 |
| 6,080,971 | A | * | 6/2000 | Seitz et al. | 219/483 |
| 2004/0187527 | A1 | | 9/2004 | Kim et al. | |
| 2005/0132756 | A1 | | 6/2005 | Yang et al. | |

FOREIGN PATENT DOCUMENTS

| | | | |
|---|---|---|---|
| DE | 3727988 | | 4/1987 |
| EP | 0877200 | | 11/1998 |
| EP | 146751 | | 10/2004 |
| EP | 1550760 | | 7/2005 |
| JP | 61-128995 | * | 6/1986 |
| JP | 3-36406 | * | 2/1991 |
| JP | 3-105101 | * | 5/1991 |

(Continued)

OTHER PUBLICATIONS

European Patent Office 0 086 465 Aug. 1983.*

(Continued)

*Primary Examiner*—Frankie L Stinson
(74) *Attorney, Agent, or Firm*—Greenblum & Bernstein, P.L.C.

(57) ABSTRACT

A steam generation apparatus for a washing machine includes: a case having an accommodating space for storing water; a heater disposed inside the case to heat the water stored in the case; and a heater overheating prevention unit for cutting off power of the heater when the heater is overheated above the set temperature, so that a fire and deflection of a case can be prevented by preventing overheating of the heater by cutting off power being supplied to the heater when the heater is overheated due to malfunctions of a water level sensor or a clogged spray nozzle or a clogged flow passage.

25 Claims, 7 Drawing Sheets

FOREIGN PATENT DOCUMENTS

| | | | |
|---|---|---|---|
| JP | 10-220706 | * | 8/1998 |
| JP | 2002-107203 | | 4/2002 |
| JP | 2003-019382 | | 1/2003 |
| JP | 2003-180602 | * | 7/2003 |
| JP | 2003-311084 | | 11/2003 |
| RU | 2013722 | | 5/1994 |
| RU | 93002387 | | 3/1995 |
| RU | 2106446 | | 3/1998 |
| RU | 2128811 | | 4/1999 |
| RU | 2216356 | | 11/2003 |
| SU | 303475 | | 7/1971 |
| SU | 505048 | | 4/1976 |
| WO | 98/49384 | | 11/1998 |

OTHER PUBLICATIONS

English Language Abstract of JP 61-128995. Jun. 1986.
English Language Abstract of 2002-107203. Apr. 2002.
English language Abstract of JP 2003-19382, Jan. 2003.
English language Abstract of RU 2106446, Mar. 1998.
English language Abstract of RU 2216356, Nov. 2003.
English language Abstract of RU 2128811, Apr. 1999.
English Language Abstract of JP 2003-311084, Nov. 2003.
English Language Abstract of DE 37 27 988, Mar. 1989.

* cited by examiner

STEAM GENERATION APPARATUS FOR WASHING MACHINE

BACKGROUND OF THE INVENTION

1. Field of the Invention

The present invention relates to a washing machine, and particularly, to a steam generation apparatus for a washing machine by heating laundry by spraying steam into the laundry.

2. Description of the Background Art

FIG. 1 is a cross-sectional view of a washing machine in accordance with the conventional art.

A drum washing machine according to the conventional art includes: a cabinet 1 forming the exterior thereof and having an openable door 4 at a front surface thereof; a tub 2 disposed in the cabinet 1 to store washing water; a drum 3 rotatably disposed inside the tub 2 to wash and dehydrate laundry; and a driving motor 7 connected to the drum 3 by a driving shaft 10 to rotate the drum 3.

A damper 6 and a support spring 5 are installed in order to buffer and support the tub 2 inside the cabinet 1. A heater 9 for heating washing water stored in the tub 2 is installed under the tub 2.

Here, a sufficient heater installing space 8 is secured under the tub 2 such that the heater 9 can be mounted therein, and the water level inside the tub 2 must be maintained above a certain degree such that the heater 9 can sufficiently sink under washing water.

The operation of the conventional drum washing machine will be described. When the washing machine is operated, washing water is supplied into the tub 2. when the water level of the tub 2 reaches a set level, the heater 9 is operated to heat the washing water. Then, while the heater 9 heats the washing water, the driving motor 7 performs forward/reverse rotations to thereby perform a washing operation. Then, when the temperature of the washing water reaches the set temperature, the heater 9 is off.

However, in the conventional washing machine, since an accommodating space should be secured under the tub 2 in order to install the heater 9 for heating laundry, the entire washing machine increases in size. In addition, since washing water should be filled even in the space for accommodating the heater 9, the washing water is heavily wasted.

In addition, since washing water is heated by the heater 9, power consumption of the heater increases, detergent remains in the heater installing space 8, the amount of detergent used increases, and washing time is extended.

SUMMARY OF THE INVENTION

Therefore, an object of the present invention is to provide a steam generation apparatus for a washing machine which can reduce an overall size of the washing machine and the amount of washing water, and can minimize power consumption and reduce washing time by spraying steam into an inner tub and heating laundry by providing the washing machine with the steam generation apparatus.

It is another object of the present invention to provide a steam generation apparatus for a washing machine which can prevent a fire and deflection of a case which may be generated due to overheating of the heater by preventing the overheating of the heater.

To achieve these and other advantages and in accordance with the purpose of the present invention, as embodied and broadly described herein, there is provided a steam generation apparatus for a washing machine which includes: a case having an accommodating space for storing water; a heater disposed inside the case to heat the water stored in the case; and a heater overheating prevention unit for cutting off power of the heater when the heater is overheated above the set temperature.

The heater overheating prevention unit includes: a temperature sensor installed inside the case to sense the temperature of the heater; and a controller for cutting off power of the heater when it is determined that the temperature of the heater is above the set temperature by receiving a signal being supplied from the temperature sensor.

The heater overheating prevention unit comprises a thermo-fuse installed inside the heater.

The heater overheating prevention unit comprises a thermostat.

The heater overheating prevention unit comprises a power interrupting unit installed inside one end portion of the heater in order to cut off power being supplied to the heater when the heater is overheated.

The temperature sensor is installed at the other end portion of the heater which is opposite to the one end portion in which the power interrupting unit of the heater is installed.

The heater is inclinedly disposed such that the one end portion at which the power interrupting unit is installed is located at a higher position than the other end portion.

A reflecting unit for reflecting radiant heat generated from the heater to prevent heat deflection of the case is installed at the inside of the case, and the reflecting unit comprises a reflector attached to the inside of the case to reflect radiant heat generated from the heater.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding qf the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Hereinafter, reference will now be made in detail to the preferred embodiments of a washing machine in accordance with the present invention, examples of which are illustrated in the accompanying drawings.

Figure 1:
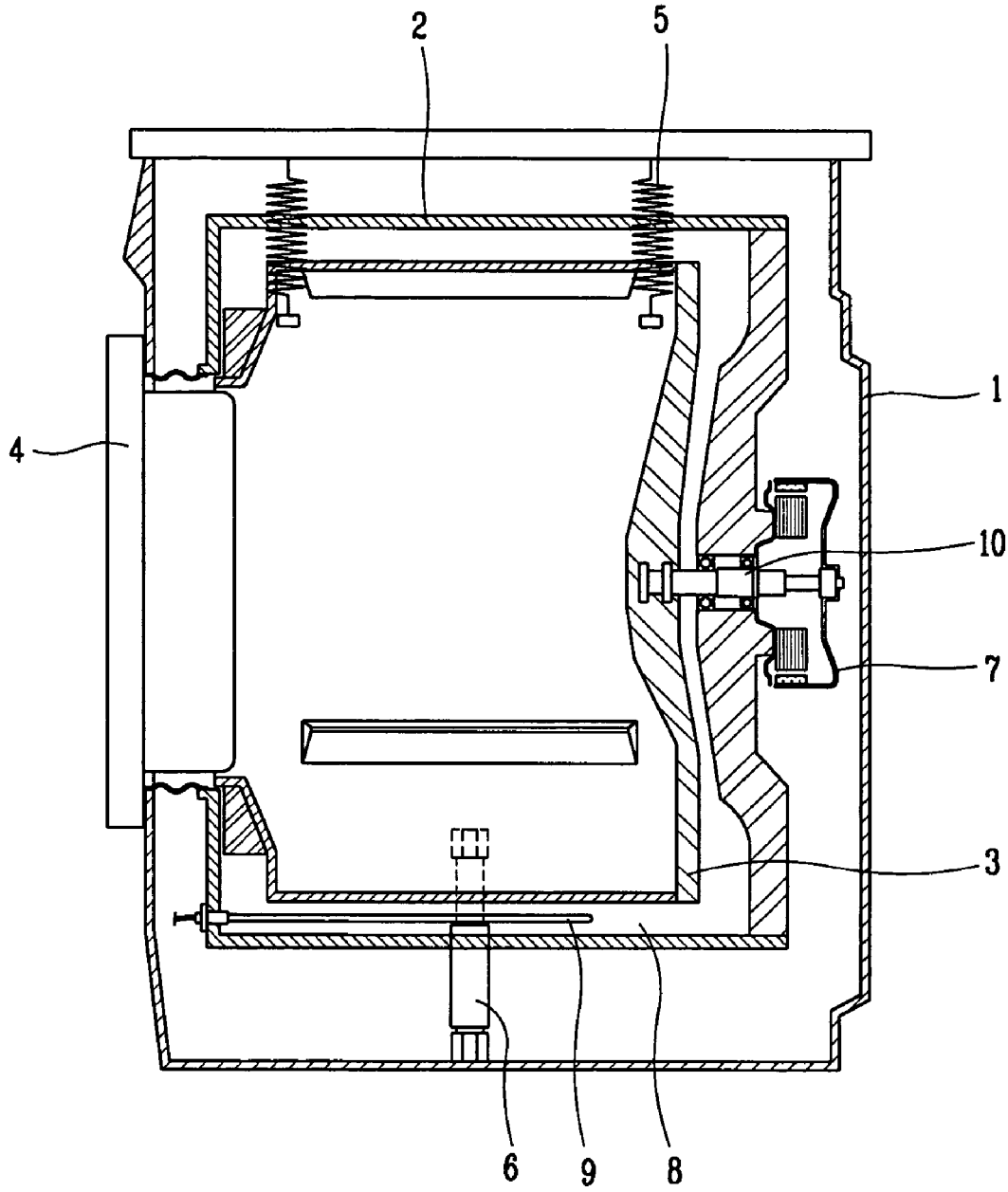
FIG. 1 CONVENTIONAL ART
FIG. 1 is a cross-sectional view of a drum washing machine in accordance with a conventional art.
Figure 2:
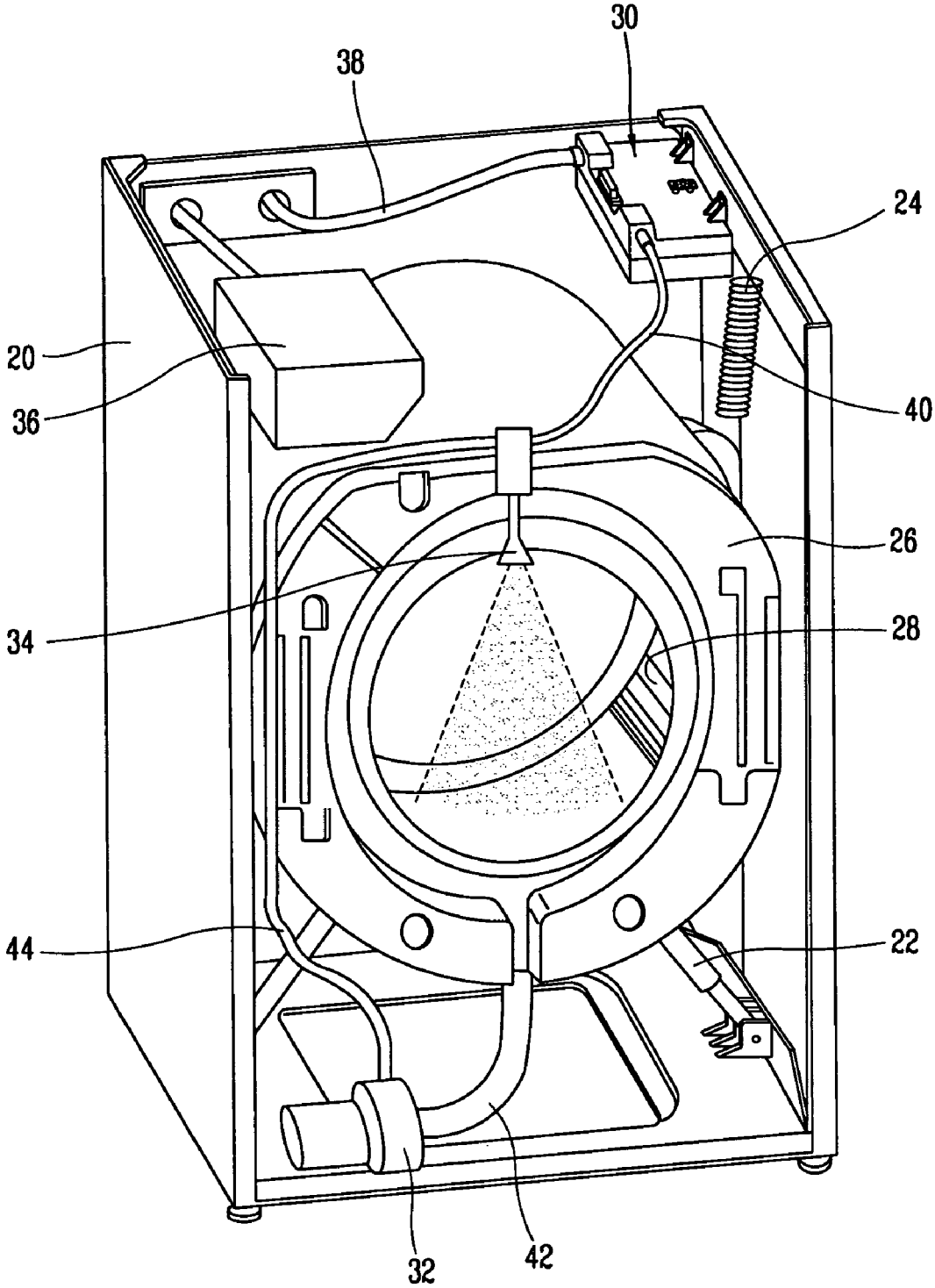
FIG. 2 is a perspective view of when the front of a washing machine having a steam generation apparatus in accordance with the present invention is opened.

FIG. 2 is a perspective view of when the front of a washing machine in accordance with a first embodiment of the present invention is opened.

A washing machine in accordance with a first embodiment of the present invention includes: a cabinet 20 forming the exterior thereof; a tub 26 buffered and supported inside the cabinet 20 by a damper 22 and a support spring 24, for storing washing water; a drum 28 rotatably disposed inside the tub 26 to wash and dehydrate laundry; a stream generation apparatus 30 disposed at an upper side of the cabinet 20 to generate steam; a circulation pump 32 disposed under the tub 26 to pump water drained from the tub 26 and re-supply the pumped water into the tub 26; and a spray nozzle 34 for spraying the steam generated from the steam generation apparatus 30 or the water circulated by the circulation pump 32 into the drum 28.

A detergent box 36 is installed at the upper side of the tub 26, and water required to wash laundry is supplied into the tub 26 together with detergent.

The steam generation apparatus 30 is connected to a water supply line 38 and supplied with water from the outside, and is connected to the spray nozzle 34 through a steam supply line 40. Here, a supply water valve (not shown) for opening and closing the water supply line 38 is installed at one side of the water supply line 38 in order to supply water to the steam generation apparatus 30 or block water supply.

The circulation pump 32 is connected to a drain pipe 42 for draining water stored in the tub 26 and to the spray nozzle 34 through a circulation line 44. The circulation pump 32 pumps water drained from the drain pipe 42 and supplies the pumped water to the spray nozzle 34 through the circulation line 44. The water supplied to the spray nozzle 34 is sprayed into the drum 28.

Figure 3:
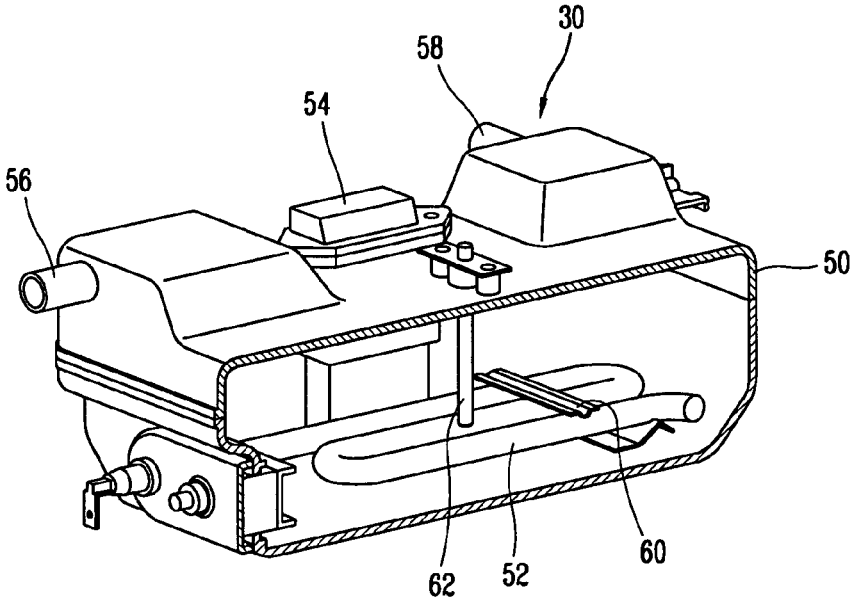
FIG. 3 is a partially cut-out perspective view of a steam generation apparatus in accordance with a first embodiment.
Figure 4:
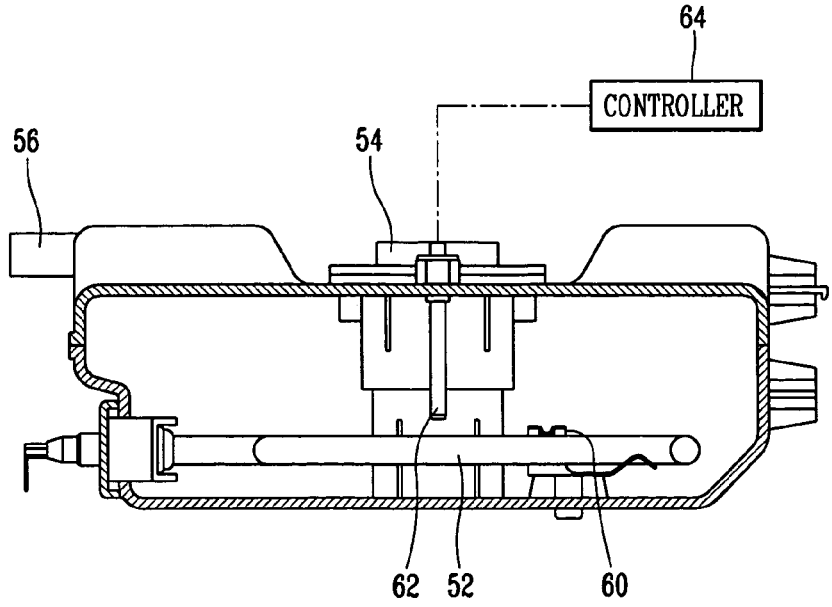
FIG. 4 is a cross-sectional view of the stream generation apparatus in accordance with the first embodiment of the present invention.

FIG. 3 is a partially cut-out perspective view of a steam generation apparatus in accordance with the first embodiment, and FIG. 4 is a cross-sectional view of the stream generation apparatus in accordance with the first embodiment of the present invention.

The steam generation apparatus 30 includes: a case 50 having an accommodating space for storing water; a heater 52 installed inside the case to heat water stored inside the case 50; a water level sensor 54 positioned inside the case 50 to sense the water level of water being supplied into the case 50; and a heater overheating prevention unit for detecting the temperature of the heater 52 and cutting off power of the heater 52 when it is overheated above the set temperature.

A water supply pipe 56 connected to the water supply line 38 and supplied with water is mounted on one side of the upper surface of the case 50. A steam exhaust pipe 58 connected to the steam supply line 40 is mounted on the other side of the upper surface of the case 50 in order to exhaust steam generated from the inside of the case 50.

The heater 52 is disposed at a lower portion of the case 50 at a certain interval from the bottom thereof. One end of the heater 52 is exposed to the outside to be connected to power. In addition, the heater 52 is supported by a heater support unit 60 positioned on the bottom of the case 50.

The water level sensor 54 that is fixed to the upper surface of the case 50 and perpendicularly disposed inside the case 50 controls the water level of water flowing into the case 50 and controls a heater protecting water level for preventing overheating of the heater 52.

when malfunctions occur in the water level sensor 54 or water stored in the case does not exist because the spray nozzle or a flow passage is clogged or the water level inside the case falls below the heater protecting water level, the heater 52 is overheated to generate a fire or deform the case 50. In order to prevent this, the heater overheating prevention unit is installed.

The heater overheating prevention unit includes a temperature sensor 62 installed inside the case 50 in order to sense the temperature of the heater 52 and a controller 64 for cutting off power of the heater 52 when it is determined that the temperature of the heater 52 is above the set temperature.

The temperature sensor 62 comprises a thermistor fixed to the upper surface of the case 50 and perpendicularly disposed inside the case 50 in order to sense the temperature of the heater 52.

The operation of the steam generation apparatus of the washing machine in accordance with the present invention will now be described.

First, after laundry is received inside the drum 28, when a user presses a steam washing operation button, water passes through the detergent box 20 and is supplied into the tub 26 together with detergent. when the water supply line 38 is opened by operating the water supply valve (not shown), water is supplied into the case 50 through the water supply pipe 56. when the water supplied to the case 50 reaches an appropriate level, power is supplied to the heater 52 by a signal being supplied from the water level sensor 54 to thereby heat the water stored in the case 50 and generate steam.

Then, when the steam generated from the inside of the case 50 is exhausted through the steam exhaust pipe 58 and is supplied to the spray nozzle 34 through the steam supply line 40, the steam is directly sprayed onto the laundry stored in the drum 28 from the spray nozzle 34.

Then, when the temperature inside the tub 26 reaches the set temperature, water supply from the case 50 is stopped by closing the water supply valve and simultaneously the operation of the steam generation apparatus 50 is stopped by cutting off power being supplied to the heater 52.

When the water level inside the case 50 is not accurately measured because of malfunctions of the water level sensor 54 during the operation of the steam generation apparatus 30, when the water level of the water stored in the case 50 falls below the heater protecting water level, the heater 52 is exposed to air and overheated rapidly. At this time, when the temperature sensor 62 detects the temperature of the heater 52 and supplies the detected temperature to the controller 64, the controller 64 cuts off the power being supplied to the heater 52 to thereby prevent overheating of the heater 52 when it is determined that the temperature of the heater 52 is overheated above the set temperature according to a signal being supplied from the temperature sensor 62.

In addition, when the temperature rises because pressure inside the case 50 increases due to the clogged spray nozzle 34 or the clogged flow passage, when the temperature sensor 62 senses it and supplies it to the controller 64, the controller 64 cuts off the power being supplied to the heater 52 to thereby prevent damage to the steam generation apparatus 30.

Figure 5:
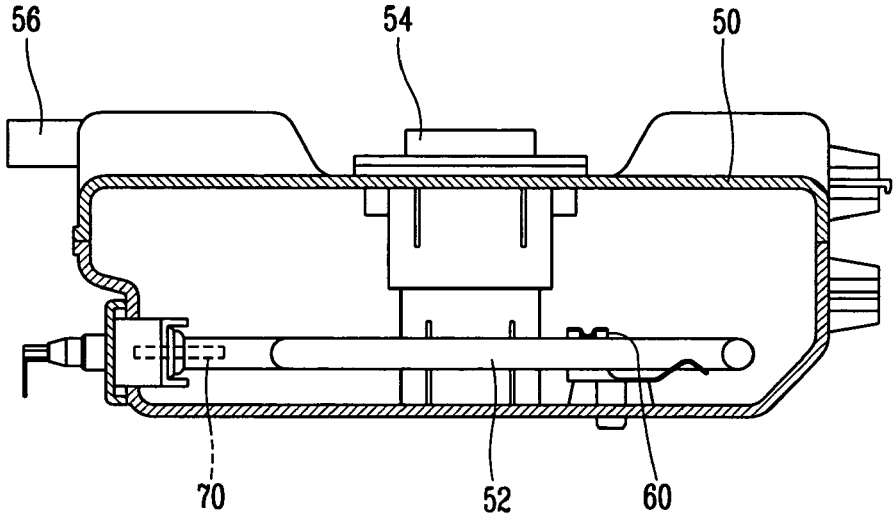
FIG. 5 is a cross-sectional view of a heater overheating prevention unit in accordance with a second embodiment of the present invention.

FIG. 5 is a cross-sectional view of a heater overheating prevention unit in accordance with a second embodiment of the present invention.

A heater overheating prevention unit in accordance with the second embodiment includes a thermo-fuse 70 installed in the heater 52 to cut off the power being supplied to the heater 52 when the heater 52 is overheated above the set temperature.

The thermo-fuse 70 is installed at one side in the heater 52. when the heater 52 is overheated above the set temperature, the thermo-fuse 70 is out, thereby cutting off the power being supplied to the heater 52.

Figure 6:
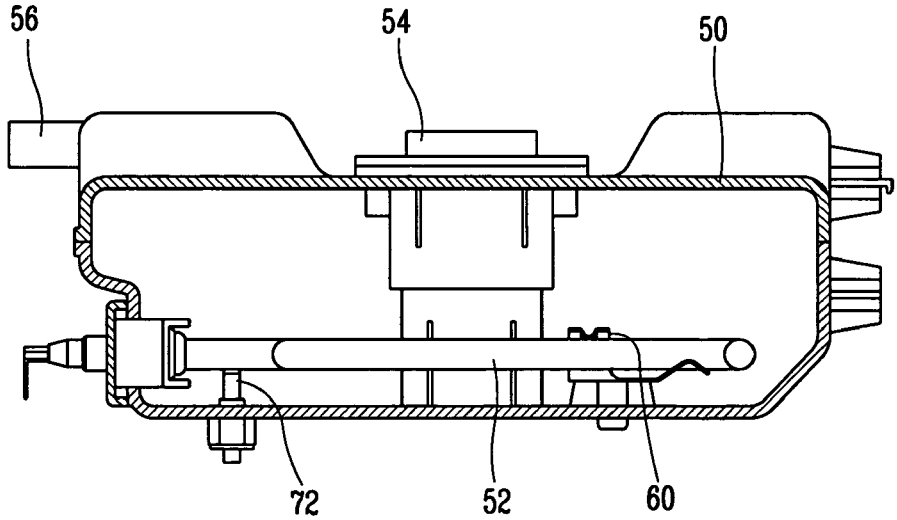
FIG. 6 is a cross-sectional view of a steam generation apparatus having a heater overheating prevention unit therein in accordance with a third embodiment of the present invention.

FIG. 6 is a cross-sectional view of a steam generation apparatus having a heater overheating prevention unit therein in accordance with a third embodiment of the present invention.

A heater overheating prevention unit in accordance with a third embodiment comprises a thermostat installed at the bottom of the case and disposed in contact with the heater in order to cut off the power being supplied to heater when the temperature of the heater rises above the set temperature.

The thermostat 72 is disposed in contact with the heater in order to cut off the power being supplied to the heater when the heater is overheated above the set temperature and to prevent overheating of the heater by supplying power to the heater when the temperature of the heater falls.

Figure 7:
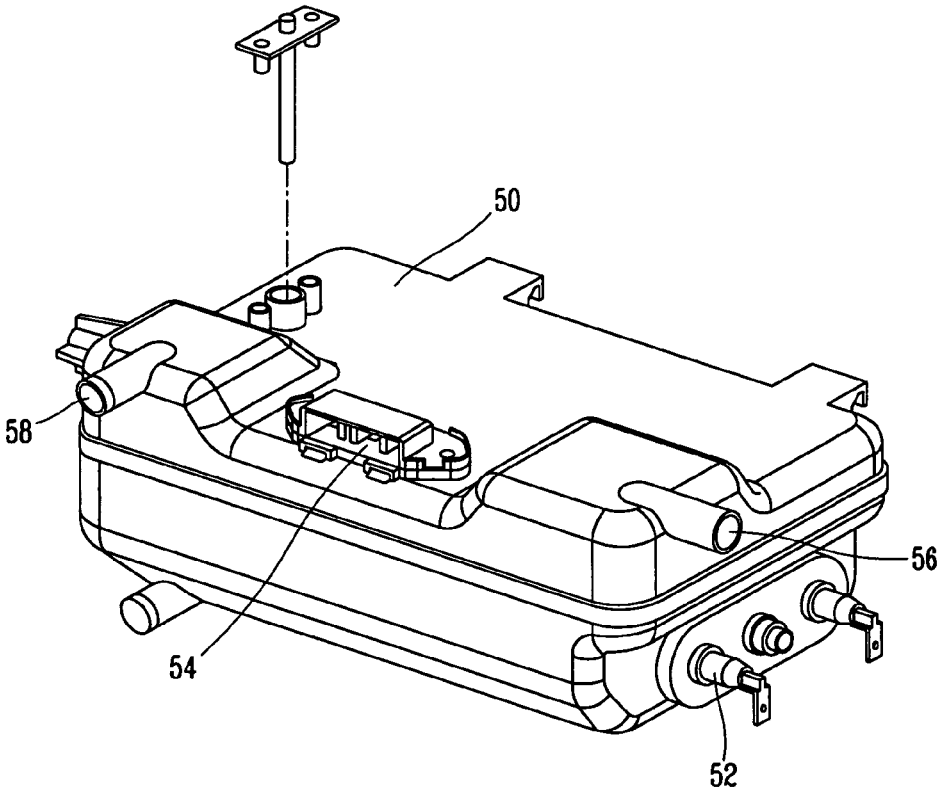
FIG. 7 is a perspective view of a steam generation apparatus in accordance with a fourth embodiment of the present invention.
Figure 8:
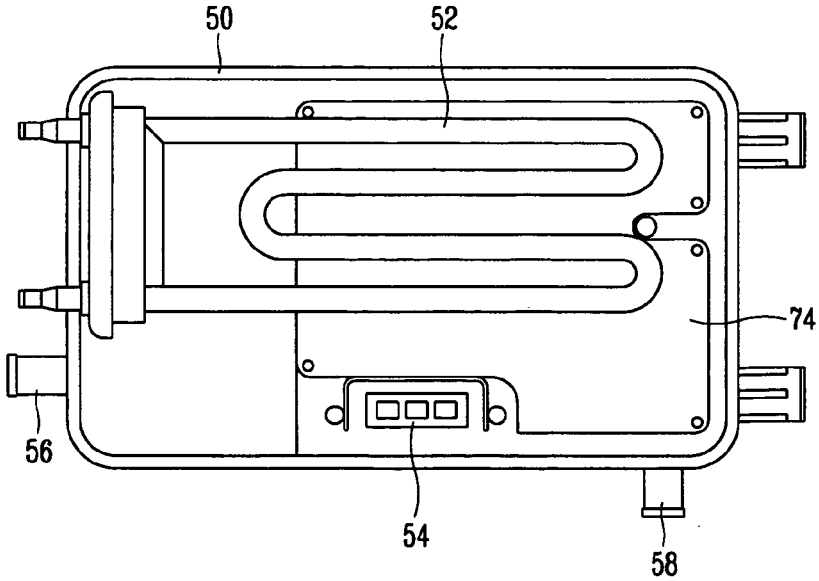
FIG. 8 is a plan view from the bottom of the steam generation apparatus in accordance with the fourth embodiment of the present invention.

FIG. 7 is a perspective view of a steam generation apparatus in accordance with a fourth embodiment of the present invention. FIG. 8 is a plan view from the bottom of the steam generation apparatus in accordance with the fourth embodiment of the present invention.

A steam generation apparatus in accordance with a fourth embodiment includes: a case 50 having an accommodating space for storing water; a heater 52 installed inside the case 50 and heating the water stored inside the case 50; a water level sensor 54 positioned inside the case 50 and sensing the water level of water supplied into the case 50; a heater overheating prevention unit detecting the temperature of the heater 52 and cutting off power of the heater 52 when the heater 52 is overheated above the set temperature; and a reflecting unit disposed at the inside of the case 50 and reflecting radiant heat generated from the heater 52 to thereby prevent heat deflection of the case 50.

Since the case 50, the heater 52 and the water level sensor 54 are the same as those described in the first embodiment, descriptions for them is omitted.

The reflecting unit includes a metallic reflector 74 attached to the upper surface of the inside of the case 50 in order to reflect heat generated from the heater 52. Here, the reflector 74 can be attached to the side and the bottom of the case 50 as well as to the upper surface thereof.

The reflecting unit may comprise reflective glass having a metallic coating film. In addition, the reflecting unit may be constructed in such a manner that instead of the reflector 74, the inside of the case 50 is coated with coatings to reflect the radiant heat generated from the heater 52.

The coatings are formed of high-reflection metallic materials, and the upper surface, the side and the bottom of the case are all coated with the coatings, preferably.

The heater overheating prevention unit prevents overheating of the heater 52 which is inclined and thus exposes its one portion to air when the heater 25 installed inside the steam generation apparatus 30 is inclined when the washing machine is inclinedly installed. That is, though the steam generation apparatus 30 is inclined downwardly toward its one side, the water level sensor 54 installed in the center of the case 50 determines that the water level of the water stored in the case 50 is normal, whereby a steam generation operation is continuously performed. Then, before the water level sensor 54 detects a point of water supply, one end portion of the heater 52 is exposed to air to thereby cause overheating of the heater 52. Accordingly, as the heater overheating prevention unit, provided is a unit capable of preventing overheating of the heater 52 even though the steam generation apparatus 30 is inclinedly disposed.

Figure 9:
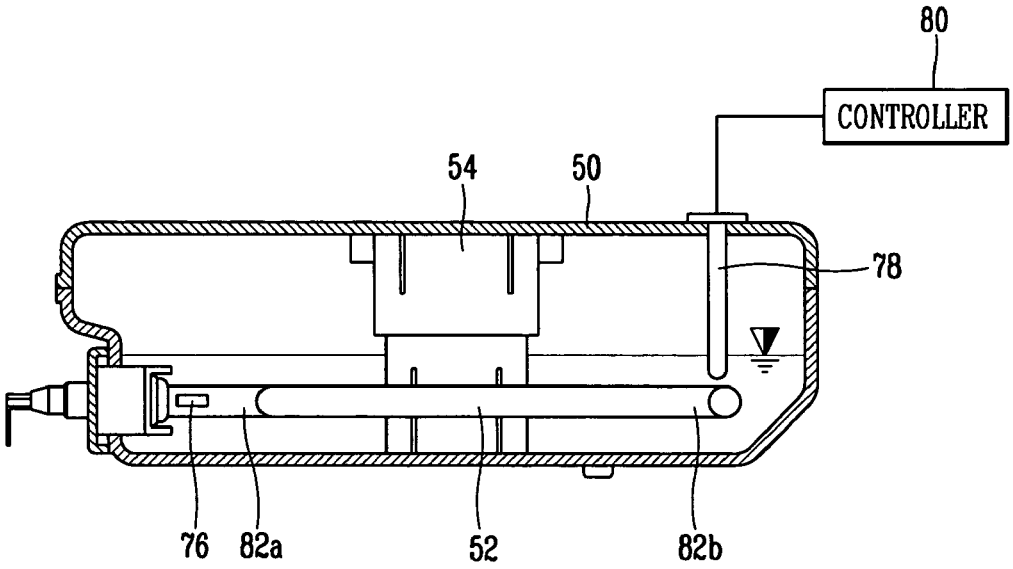
FIG. 9 is a cross-sectional view of the steam generation apparatus in accordance with a fourth embodiment of the present invention.

The heater overheating prevention unit in accordance with the fourth embodiment, as shown in FIG. 9, a power interrupting unit 76 is installed inside one end portion (82*a*) of the heater 52 in order to cut off power being supplied to the heater when the heater 52 is overheated above the set temperature. In addition, a temperature sensor 78 is installed at a position adjacent to the other end portion 82*b* of the heater 52 which is opposed to said one end portion 82*a* in which the power interrupting unit 76 of the heater 52 is installed such that the temperature sensor 78 senses the temperature of the heater 52 and supplies a signal to a controller 80.

As the power interrupting unit 76, a thermo-fuse installed at one end portion inside the heater 52 is used. when the heater 52 is overheated, the thermo-fuse is out, thereby cutting off the power being supplied to the heater 52. In addition, as the power interrupting unit 76, used is a thermostat in contact with the one end portion of the heater 52 so as to cut off the power being supplied to the heater 52 when the heater 52 is overheated above the set temperature and so as to supply power to the heater 52 when the heater 52 falls below the set temperature.

The temperature sensor 78 comprises a thermistor fixed to the upper surface of the case 50, disposed adjacently to the other end portion 82*b* of the heater 52 and electrically connected to the controller 80 in order to sense the temperature of the other end portion 82*b* of the heater 52 and supplying the sensed temperature to the controller 80.

In the heater overheating prevention unit in accordance with the fourth embodiment, when the washing machine is inclined downwardly toward its one side, when the steam generation apparatus 30 is inclined downwardly toward the left in the drawing, the other end portion 82*b* of the heater 52 is exposed to air to cause overheating of the heater 52. At this time, when the temperature sensor 78 senses the temperature of the heater 52 and supplies the sensed temperature to the controller 80, the controller 80 cuts off the power being supplied to the heater 52 to thereby prevent overheating of the heater 52.

In opposition to this, when the steam generation apparatus is inclined downwardly toward the right in the drawing, the one end portion 82*a* of the heater is exposed to air to cause overheating of the heater. At this time, the power interrupting unit 76 is operated to cut the power being supplied to the heater and prevent overheating of the heater 52.

Figure 10:
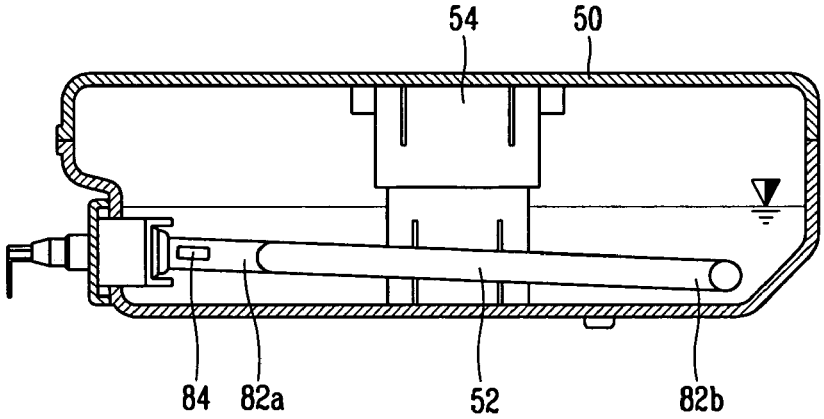
FIG. 10 is a cross-sectional view illustrating a steam generation apparatus having a heater overheating prevention unit in accordance with a fifth embodiment of the present invention.

FIG. 10 is a cross-sectional view illustrating a steam generation apparatus having a heater overheating prevention unit in accordance with a fifth embodiment of the present invention.

In a heater overheating prevention unit in accordance with a fifth embodiment, a power interrupting unit 84 is installed inside the one end portion 82*a* in order to cut off the power being supplied to the heater 52 when the heater 52 is overheated over the set temperature. The heater 52 is installed in such a manner that the one end portion 82*a* in which the power interrupting unit 84 is installed is located at a high position than the other end portion 82*b*.

The power interrupting unit 84 has the same construction as the power interrupting unit 76 described in the fourth embodiment, and therefore a description therefor will be omitted.

That is, the heater overheating prevention unit in accordance with the fifth embodiment can prevent exposure to air because when the steam generation apparatus 30 is inclined downwardly toward the right in the drawing, the other end portion 82*b* is disposed to be downwardly inclined and therefore is located below the heater protecting water level. The heater overheating prevention unit prevents overheating of the heater 52 in such a manner that when the steam generation apparatus 30 is inclined downwardly toward the left in the drawing, the one end portion 82*a* of the heater 52 is exposed to air, and at this time the power interrupting unit 84 is operated to cut off the power being supplied to the heater 52.

Figure 11:
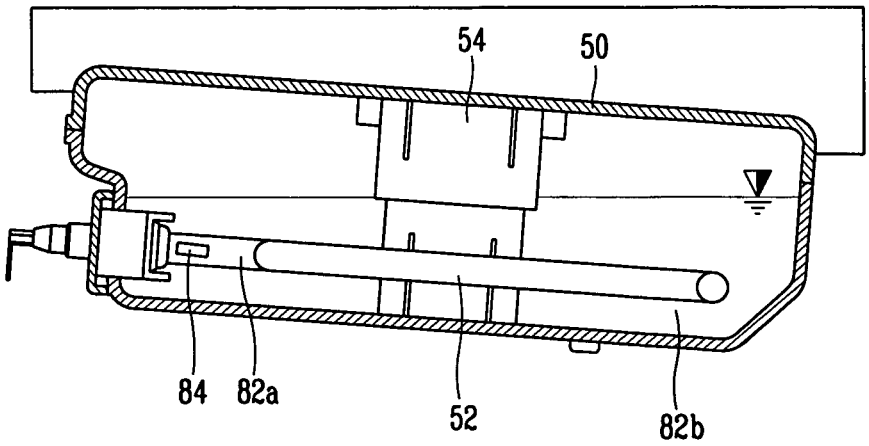
FIG. 11 is a cross-sectional view of a steam generation apparatus having a heater overheating prevention unit in accordance with a sixth embodiment.

FIG. 11 is a cross-sectional view of a steam generation apparatus having a heater overheating prevention unit in accordance with a sixth embodiment.

In a heater overheating prevention unit in accordance with a sixth embodiment, a power interrupting unit 86 is installed inside the one end portion of the heater 52 in order to cut off the power being supplied to the heater when the heater 52 is overheated above the set temperature, and the steam generation apparatus 30 is inclinedly disposed with its right portion thereof lowered in the drawing.

In the heater overheating prevention unit in accordance with the six embodiment, since the right side surface of the steam generation apparatus 30 at which the other end portion 82*b* is located is disposed to be downwardly inclined, the other end portion 82*b* of the heater 52 is located below the heater protecting water level. Accordingly, even when the steam generation apparatus 30 is inclined downwardly toward the left direction, the heater overheating prevention unit can prevent the other end portion 82*b* from being exposed to air. In addition, when the steam generation apparatus 30 is inclined downwardly toward the right, the one end portion 82*a* of the heater 52 is exposed to air. At this time, a power interrupting unit 86 is operated to cut off the power being supplied to the heater 52 and prevent overheating of the heater 52.

Figure 12:
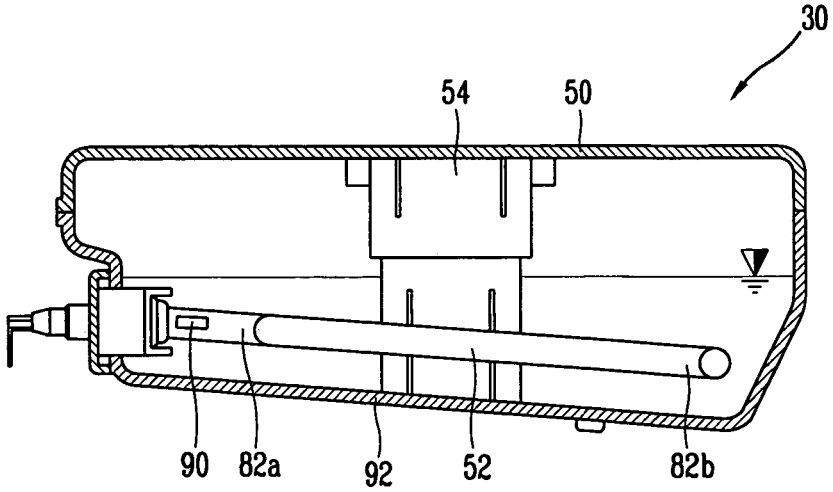
FIG. 12 is a cross-sectional view of a steam generation apparatus having a heater overheating prevention unit in accordance with a seventh embodiment of the present invention.

FIG. 12 is a cross-sectional view of a steam generation apparatus having a heater overheating prevention unit in accordance with a seventh embodiment of the present invention.

In a heater overheating prevention unit in accordance with a seventh embodiment, a power interrupting unit 90 is installed inside the one end portion 82*a* of the heater 52 to cut off the power being supplied to the heater 52 when the heater 52 is overheated above the set temperature, and an incline 92 which is inclined with its right portion lowered in the drawing is formed on the bottom of the case 50 of the steam generation apparatus 30.

In the heater overheating prevention unit in accordance with the seventh embodiment, since the right portion of the steam generation apparatus 30 at which the other end portion 82*b* is located is formed to be inclined downwardly, the other end portion 82*b* of the heater 52 is located below the heater protecting water level. Accordingly, even when the steam generation apparatus 30 is inclined downwardly toward the left, the heater overheating prevention unit can prevent the other end portion 82*b* from being exposed to air. In addition, when the steam generation apparatus 30 is inclined downwardly toward the left in the drawing, the one end portion 82*a* of the heater 52 is exposed to air. At this time, a power interrupting unit 86 is operated to cut off the power being supplied to the heater 52 and prevent overheating of the heater 52.

The heat generation apparatus of the washing machine in accordance with the present invention can reduce an overall size of the washing machine and the amount of water used, and can minimize power consumption and reduce washing time by spraying steam into an inner tub and heating laundry.

In addition, a heater overheating prevention unit is installed at the steam generation apparatus in order to cut off power being supplied to the heater and prevent overheating of the heater when the heater is overheated due to malfunctions of a water level sensor or a clogged spray nozzle or a clogged flow passage, so that the present invention can prevent a fire and deflection of a case.

In addition, a reflecting unit for reflecting radiant heat generated from the heater is installed at the inside of the case, so that deflection of the case which is caused by the radiant heat can be prevented.

In addition, even when the washing machine is inclinedly disposed, overheating of the heater can be prevented by preventing the heater from being exposed to air.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A laundry machine, comprising:

a cabinet configured to form an exterior of the laundry machine;

a drum configured to hold laundry;

a steam generation apparatus configured to generate steam, the steam generation apparatus comprising:

a case having an accommodating space which stores water, the case fitting within the cabinet of the laundry machine;

a water level sensor disposed inside the case to sense a level of water in the case, the water level sensor outputting a signal when a level of water in the case reaches a predetermined level;

a heater configured to heat the water stored in the case; and a heater overheating preventer configured to remove power to the heater when a temperature of the heater is above a set temperature;

a water supply line configured to supply water to the steam generation apparatus;

a steam supply line to supply the steam generated in the steam generation apparatus to the drum; and controller configured to control operation of the laundry machine, the controller controlling the steam generation apparatus to supply the steam to the drum when treating the laundry in the drum.

2. The apparatus of claim 1, wherein the heater overheating preventer includes:

a temperature sensor installed inside the case to sense the temperature of the heater; and a power controller which receives a signal from the temperature sensor and removes power to the heater when the controller determines that the temperature of the heater is above the set temperature.

3. The apparatus of claim 2, wherein the temperature sensor comprises a thermistor.

4. The apparatus of claim 3, wherein the thermistor is fixed to an upper portion of the case and is perpendicularly disposed inside the case.

5. The apparatus of claim 1, wherein the heater overheating preventer comprises a thermo-fuse installed inside the heater.

6. The apparatus of claim 1, wherein the heater overheating preventer comprises a thermostat.

7. The apparatus of claim 6, wherein the thermostat is installed at a bottom of the case and disposed in contact with the heater.

8. The apparatus of claim 1, wherein the heater overheating preventer comprises a power interrupter installed inside one end portion of the heater which removes power supplied to the heater when the heater is overheated.

9. The apparatus of claim 8, wherein the power interrupter comprises a thermo-fuse.

10. The apparatus of claim 8, wherein the power interrupter comprises a thermostat.

11. A laundry machine, comprising:

a cabinet configured to form an exterior of the laundry machine;

a drum configured to hold laundry;

a steam generation apparatus configured to generate steam, the steam generation apparatus comprising;

a case having an accommodating space which stores water;

a heater, disposed inside the case, which heats the water stored in the case;

a power interrupter, disposed at a first end of the heater, which cuts off power to the heater; and a temperature sensor, disposed adjacent to a second end of the heater opposite the first end, which senses a temperature of the second end of the heater;

a water supply line configured to supply water to the steam generation apparatus;

a steam supply line configured to supply the steam generated in the steam generation apparatus to the drum; and a controller configured to control operation of the laundry machine, the controller controlling the steam generation apparatus to supply the steam to the drum when treating the laundry in the drum and controlling the power interrupter to cut off the power to the heater when the sensed temperature by the temperature sensor reaches a set temperature.

12. The apparatus of claim 11, wherein the temperature sensor comprises a thermistor.

13. The apparatus of claim 11, further comprising:

a reflector installed inside the case which reflects radiant heat generated from the heater and prevents heat-deflection of the case.

14. The apparatus of claim 13, wherein the reflector is attached to an upper side of the case.

15. The apparatus of claim 13, wherein the reflector comprises a high-reflection coating.

16. The apparatus of claim 11, further comprising a heater support that supports the heater on the case.

17. A steam generation apparatus for a laundry machine, comprising:

a case having an accommodating space which stores water;

a heater, disposed inside the case, which heats the water stored in the case; and a power interrupter, disposed at one end portion of the heater, which removes power to the heater when the heater is overheated, wherein the heater is disposed at an incline, such that the one end portion of the heater in which the power interrupter is installed is located at a higher position than an opposite end portion of the heater.

18. The apparatus of claim 17, further comprising:

a reflector installed inside the case which reflects radiant heat generated from the heater and prevents heat-deflection of the case.

19. The apparatus of claim 17, further comprising:

a heater support disposed inside the case to support the heater, wherein one end of the heater is exposed outside of the case to connect to a power source and another end of the heater is disposed inside of the case.

20. A steam generation apparatus for a laundry machine, comprising:

a case having an accommodating space which stores water;

a heater, disposed inside the case, which heats the water stored in the case; and a power interrupter, disposed at one end portion of the heater, which cuts off power to the heater when a temperature of the one end portion of the heater exceeds a set temperature, wherein the steam generation apparatus is installed in the laundry machine at an incline, such that the one end portion of the heater in which the power interrupter is installed is located at a higher position than an opposite end portion of the heater.

21. The apparatus of claim 20, further comprising:

a reflector installed inside the case which reflects radiant heat generated from the heater and prevents heat-deflection of the case.

22. The apparatus of claim 20, further comprising:

a heater support disposed inside the case to support the heater, wherein one end of the heater is exposed outside of the case to connect to a power source and another end of the heater is disposed inside of the case.

23. A steam generation apparatus for a laundry machine, comprising:

a case having an accommodating space which stores water;

a heater, disposed inside the case, which heats the water stored in the case; and a power interrupter, disposed at one end portion of the heater, which removes power to the heater when a temperature of the one end portion of the heater exceeds a set temperature, wherein a bottom of the case is formed at an incline such that an end of the bottom of the case adjacent to the one end portion of the heater in which the power interrupter is installed is located at a higher position than an opposite end of the bottom of the case. the heater is disposed inside of the case.

24. The apparatus of claim 23, further comprising:

a reflector installed inside the case which reflects radiant heat generated from the heater and prevents heat-deflection of the case.

25. The apparatus of claim 23, further comprising:

a heater support disposed inside the case to support the heater, wherein one end of the heater is exposed outside of the case to connect to a power source and another end of the heater is disposed inside of the case.

* * * * *

UNITED STATES PATENT AND TRADEMARK OFFICE

CERTIFICATE OF CORRECTION

PATENT NO. : 7,490,494 B2
APPLICATION NO. : 11/178426
DATED : February 17, 2009
INVENTOR(S) : Kim et al.

It is certified that error appears in the above-identified patent and that said Letters Patent is hereby corrected as shown below:

At column 8, line 43 (claim 1, line 22) of the printed patent, "a" should be added before controller.

Signed and Sealed this

Twenty-sixth Day of May, 2009

John Doll

JOHN DOLL
*Acting Director of the United States Patent and Trademark Office*